United States Patent [19]

Wentzell

[11] 4,435,342

[45] Mar. 6, 1984

[54] METHODS FOR PRODUCING VERY FINE PARTICLE SIZE METAL POWDERS

[76] Inventor: Jospeh M. Wentzell, Ty Careg, Remsen, N.Y. 13438

[21] Appl. No.: 318,261

[22] Filed: Nov. 4, 1981

[51] Int. Cl.[3] ..... B01J 2/02

[52] U.S. Cl. ..... 264/8; 264/9

[58] Field of Search ..... 264/8, 9

[56] References Cited

U.S. PATENT DOCUMENTS

| | | | |
|---|---|---|---|
| 2,488,353 | 11/1949 | Unger | 264/9 |
| 3,660,544 | 5/1972 | Young et al. | 264/8 |
| 3,963,812 | 6/1976 | Schlienger | 264/8 |
| 4,127,158 | 11/1978 | Matsumo | 264/8 |
| 4,140,462 | 2/1979 | Thompson | 264/8 |

*Primary Examiner*—James R. Hall

*Attorney, Agent, or Firm*—Buell, Blenko, Ziesenheim & Beck

[57] ABSTRACT

A method is provided for producing ultra fine particles of metal by delivering a molten stream of metal onto a rotating primary annular surface, discharging molten fine droplets from the edge of the primary annular surface against an inclined secondary annular surface surrounding the primary surface at an angle such that the molten droplets striking the secondary surface are subdivided and discharged from the secondary surface to be cooled and collected as ultra fine particles.

12 Claims, 5 Drawing Figures

METHODS FOR PRODUCING VERY FINE PARTICLE SIZE METAL POWDERS

This invention relates to methods for producing very fine particle size metal powders and particularly to methods and apparatus for producing a major portion of metal particles of less than about 44 microns.

The use of super-alloy powders has expanded to become the most important area of materials development in the gas turbine business. There are some non-metallics in all commercially produced super-alloys. When a coarse super-alloy powder is used, there is always the chance that some coarse non-metallics will be present. Unfortunately coarse non-metallics have a deleterious effect on fatigue life and are undesirable in powder to be used in gas turbines. This problem is well-known and recognized in the industry.

The processes which are currently used to produce fine metal powders all require the use of gas. Those processes, which use argon, produce powder having quantities of argon being entrapped in the powder. In addition these gas processes along with the spinning disk, spinning cup and rotating electrode systems heretofore used have difficulty in producing very fine particle sizes, i.e., those less than 44 microns (about 0.00175 inch) in diameter.

None of these processes will yield powder of more than 50% less than 44 micron. Since the demand for minus 44$\mu$ powder has grown to about 50% of the total super-alloy powder requirements and is expected to grow at an exponential rate, it is obvious that present methods will not be able to satisfy those requirements economically. In addition, other powder applications such as aluminum-lithium powder for the air frame industry are demanding larger quantities of very fine powder.

I have developed a new method which will produce a major portion of metal powder product having a size less than 44$\mu$ and which is free from the undesirable entrapped gases which characterize currently used processes.

I preferably deliver a stream of molten metal to be atomized from a rapidly rotating primary annular surface, as moderately fine droplets of molten metal against a secondary annular inclined surface surrounding the rotating annular surface at an angle inclined to the path of the metal to cause the fine droplets to break up into smaller droplets. The secondary annular sloping surface must have an angle sufficient to prevent sticking of the metal on the secondary sloping surface as it impacts from the primary annular surface. Preferably the rotating primary annular surface is a dish surface and the inclined surface is a disk surrounding the dish surface. Preferably the molten metal to be powdered is teemed as a stream off center of the dish to create a fan like pattern which strikes the inclined surface. The inclined secondary surface may be rotated around the primary dish, preferably counter to the rotation of the primary dish, or vibrated or simply stationary. The secondary inclined surface may be heated to elevated temperatures or be at ambient temperature, or any temperature between as desired. The secondary inclined surface may be cold copper, chrome plated copper, a superalloy, tungsten or ceramic. Where high purity of powder is desired, I preferably use disk and secondary surface of the same material as that being atomized. The primary rotating annular surface may be a spinning bar or electrode from which molten droplets are expelled against the secondary annular surface. Alternatively, the primary surface and secondary surfaces may be part of a single rotating element.

In the foregoing general description I have set out certain objects, purposes and advantages of this invention. Other objects, purposes and advantages of this invention will be apparent from the following description and the accompanying drawings in which.

Figure 4:
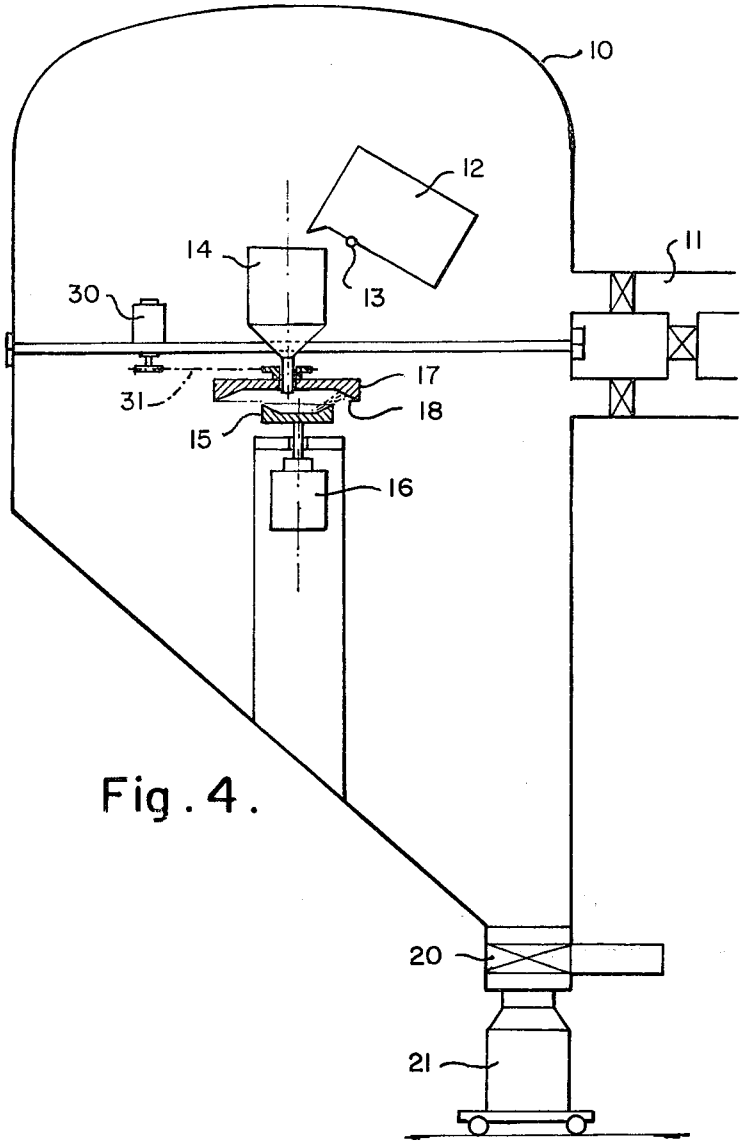
FIG. 4 is a schematic section of the apparatus of FIG. 1, showing means for rotating the two rings; an FIG. 5 is a schematic section of the apparatus of FIG. 1, showing means for vibrating and heating the secondary ring.

Referring to the drawings, I have illustrated a housing 10 containing an atomizing apparatus according to my invention. The atmosphere within housing 10 may be controlled by atmosphere control unit 11 alongside the housing 10. The atomizing apparatus is made up of a ladle or furnace 12 mounted on a pivot shaft 13 to pour molten metal to be atomized into teeming ladle 14 mounted in the housing above a rotating dish 15 to deliver a stream of molten metal onto the surface of dish 15. Dish 15 is rotated by motor 16. A secondary annular ring 17 surrounds dish 15 and is provided with a sloping surface 18 facing the edge of dish 15 at an angle 17*a* inclined to the path 15*a* of the molten droplets sufficient to cause molten droplets striking it from the edge of dish 15 to be broken up into smaller droplets and discharged through the free space 19 within housing 10, cooled and collected into the sloping bottom of housing 10. This ring 17 may be rotated by motor 30 and chain 31 as shown in FIG. 4. The motor may be connected to an outside power source by conventional wiring, not shown. The fine powder is removed through valve 20 at the bottom of housing 10 into can 21.

Figure 5:
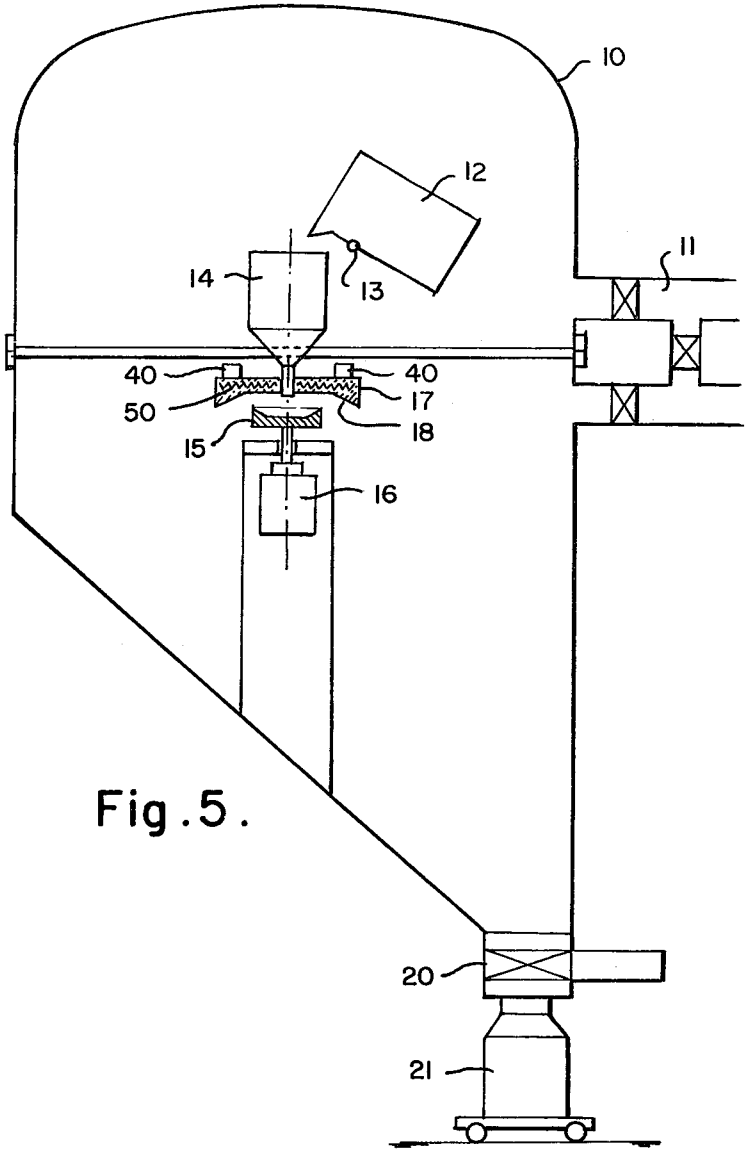

Preferably the annular ring 17 is oscillated vertically by vibrators 40 attached to its top surface (FIG. 5) which may be energized from an outside power source by conventional wiring, not shown to change the impact area and reduce erosion on the sloping surface. The annular ring 17 is also preferably heated to an elevated temperature, for example by heater coil 50 in the body of the ring (FIG. 5) which may be energized from an outside power source by conventional wiring, not shown.

The invention can perhaps be best understood by reference to the following example in which a molten superalloy is teemed from teeming ladle 14 onto a rotating dish 15 at about its center, the dish having a five inch diameter and rotated at 5000 r.p.m. The molten metal is discharged as fine droplets against the sloping inner face 18 of annular ring 17 which surrounds dish 15. The sloping face 18 is inclined outwardly at about 28° to the droplet path from dish 15. The fine droplets striking face 18 are broken up again to produce a resultant product having particles predominantly in the range 2.5 microns to 10 microns.

It is essential that the sloping surface 18 have an angle inclined to the path of the metal sufficient to cause further breakup or atomization of the droplets striking it and sufficient to prevent sticking of the metal on the surface.

Figure 2:
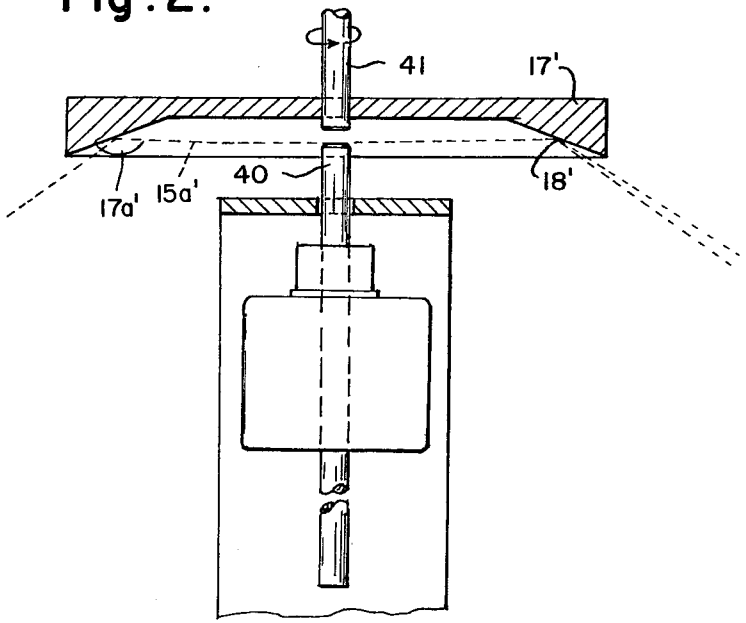
FIG. 2 is a fragmentary section of a second embodiment.
Figure 1:
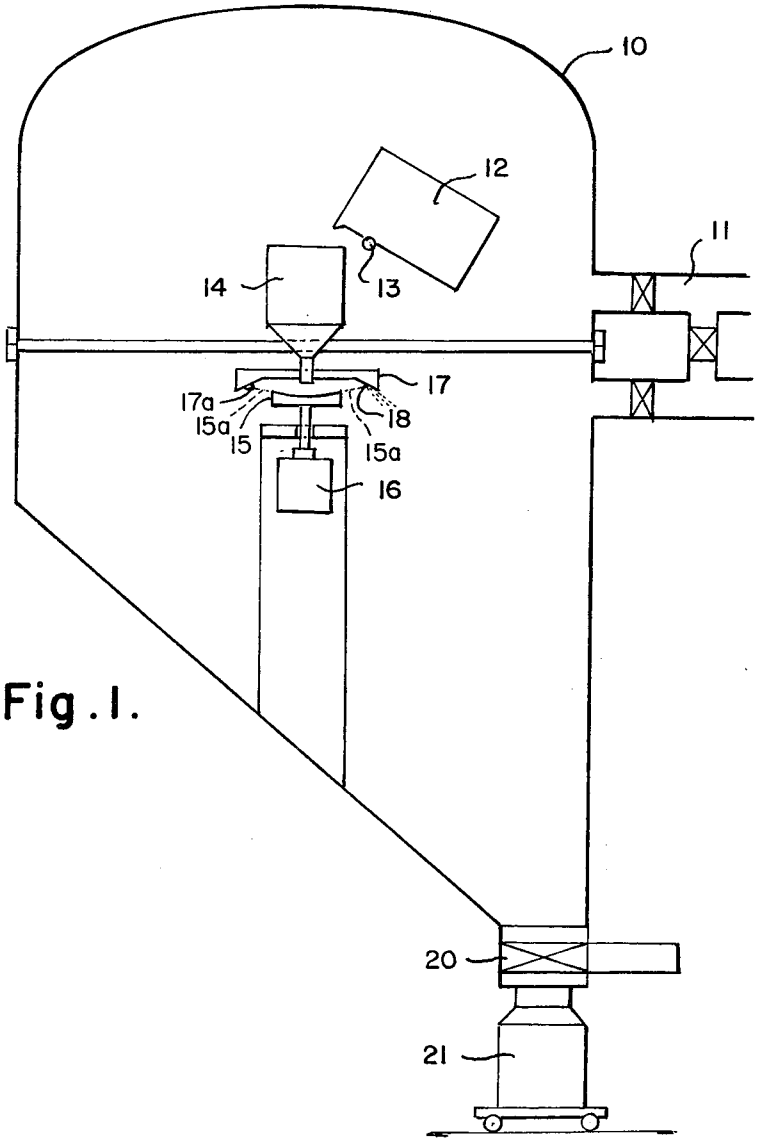
FIG. 1 is a schematic section through an apparatus according to this invention for producing fine particle size metal powders.

In FIG. 2, I have illustrated an apparatus which operates in a fashion similar to that of FIG. 1 except that a spinning vertical bar electrode 40 is substituted for dish 15 opposite graphite electrode 41 and supplies the molten droplets as its end melts.

Figure 3:
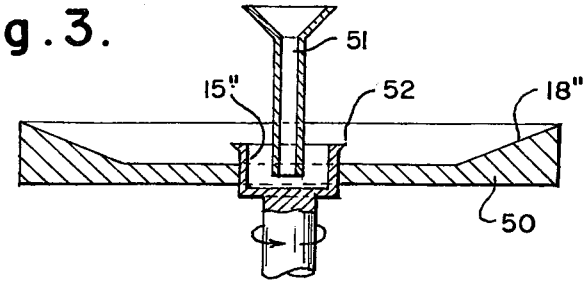
FIG. 3 is a fragmentary section of a third embodiment.

In FIG. 3, I have illustrated a third embodiment in which both the primary dish 15″ and the sloping face 18″ are formed in a single unit 50. In this embodiment, molten metal is delivered through a teeming spout 51 into a hollow cylindrical dish 15″. The molten metal is thrown as droplets off the edge 52 of dish 15″ as it rotates at high speed and the droplets strike the sloping face 18″ at the outer circumference of unit 50. This causes the droplets to be broken up into finer droplets which are thrown into the atmosphere around unit 50 and cooled.

In the foregoing specification, I have set out certain preferred practices and embodiments of my invention however it will be understood that this invention may be otherwise practiced within the scope of the following claims.

I claim:

1. A method of producing ultra fine solid metal particles comprising the steps of:

(a) discharging droplets of molten metal from a rotating primary member having a substantially circular periphery in a generally radial path from said rotating member tangentially against a spaced secondary annular planar surface surrounding and spaced from the periphery of the rotating primary member, said annular planar surface being inclined to the path of the droplets of molten metal from the rotating member at an angle such that the droplets are free from any tendency for the metal to stick to said annular planar surface and such that the molten droplets are further atomized into finer droplets which continue tangentially beyond said secondary annular surface into a cooling environment;

(b) cooling said finer droplets in said cooling environment to solidify the droplets to solid particles; and (c) collecting said cooled particles as ultra fine solid metal particles.

2. A method of producing ultra fine solid metal particles as claimed in claim 1 wherein the rotating primary member is a rotating disc onto which is vertically directed a stream of molten metal.

3. A method as claimed in claim 2 wherein the rotating disc has a concave shape.

4. A method as claimed in claim 1 wherein the rotating primary member is a rotating metal electrode whose end is being melted.

5. A method as claimed in claim 1 or 2 or 4 or 3 wherein the secondary annular surface is rotated counter to the rotating primary member.

6. A method as claimed in claim 1 or 2 or 4 or 3 wherein the secondary annular surface is rotated in the same direction as the rotating primary member.

7. A method as claimed in claim 1 or 2 or 4 or 3 wherein the secondary annular surface is vibrated vertically in the path of the molten droplets from the primary member.

8. A method as claimed in claims 1 or 2 or 4 or 3 wherein the secondary annular surface is heated to an elevated temperature.

9. A method as claimed in claims 1 or 2 or 4 or 3 wherein the molten metal is teemed onto said primary annular surface off-center of said primary surface.

10. A method as claimed in claim 8 wherein the molten metal is teemed onto said primary annular surface off-center of said primary surface.

11. A method as claimed in claim 9 wherein the molten metal is teemed onto said primary annular surface off-center of said primary surface.

12. A method as claimed in claim 3 wherein the molten metal is teemed onto said primary annular surface off-center of said primary surface.

* * * * *